US006864774B2

(12) United States Patent
Kanetaka et al.

(10) Patent No.: US 6,864,774 B2
(45) Date of Patent: Mar. 8, 2005

(54) INDUCTANCE COMPONENT AND METHOD OF MANUFACTURING THE SAME

(75) Inventors: Toyonori Kanetaka, Toyooka (JP); Toshihiro Yoshizawa, Toyonaka (JP); Hiromasa Yamamoto, Toyonaka (JP)

(73) Assignee: Matsushita Electric Industrial Co., Ltd. (JP)

( * ) Notice: Subject to any disclaimer, the term of this patent is extended or adjusted under 35 U.S.C. 154(b) by 56 days.

(21) Appl. No.: 10/168,171

(22) PCT Filed: Oct. 10, 2001

(86) PCT No.: PCT/JP01/09087

§ 371 (c)(1),
(2), (4) Date: Aug. 1, 2002

(87) PCT Pub. No.: WO02/33714

PCT Pub. Date: Apr. 25, 2002

(65) Prior Publication Data

US 2003/0052765 A1 Mar. 20, 2003

(30) Foreign Application Priority Data

Oct. 19, 2000 (JP) ..... 2000-319014
Oct. 30, 2000 (JP) ..... 2000-330232
Oct. 30, 2000 (JP) ..... 2000-330233

(51) Int. Cl.[7] ..... H01F 27/02
(52) U.S. Cl. ..... 336/83; 336/200
(58) Field of Search ..... 336/65, 83, 200, 336/206–208, 220–222, 232

(56) References Cited

U.S. PATENT DOCUMENTS 6,388,550 B1 * 5/2002 Kanetaka et al. ..... 336/223
6,393,691 B1 * 5/2002 Ogawa et al. ..... 29/602.1
6,535,095 B2 * 3/2003 Aoki et al. ..... 336/83

FOREIGN PATENT DOCUMENTS

| | | |
|---|---|---|
| JP | 10-247603 | 9/1998 |
| JP | 11-67521 | 3/1999 |
| JP | 2000-30952 | 1/2000 |
| JP | 2000-289038 | 9/2000 |

* cited by examiner

*Primary Examiner*—Tuyen T. Nguyen
(74) *Attorney, Agent, or Firm*—Parkhurst & Wendel, L.L.P.

(57) ABSTRACT

An inductance component comprising a column-shaped magnetic material substrate 21, conductor layer 24 covering ends and a peripheral surface of the substrate, coil portion 27 having groove portion 25 and wire conductor portion 26 formed in the conductor layer covering the peripheral surface, electrode portions 28 including the conductor layer covering the ends of the substrate, and magnetic material portion 31 made of sintered magnetic material on the coil portion, wherein the conductor layer has a melting point higher than a sintering temperature of the sintered magnetic material. The manufacturing process comprises forming a substrate, forming a conductor layer, forming a coil portion, forming electrode portions at ends of the substrate, and forming a magnetic material portion of sintered magnetic material on the coil portion. The present invention provides an inductance component with high inductance, low magnetic flux leakage, and less undesirable magnetic effects on adjacent components.

18 Claims, 11 Drawing Sheets

INDUCTANCE COMPONENT AND METHOD OF MANUFACTURING THE SAME

TECHNICAL FIELD

The present invention relates to an inductance component used in electronic equipment, communication equipment and the like, and a method of manufacturing the same.

BACKGROUND ART

A conventional inductance component is described in the following with reference to the drawings.

FIG. 16 is a sectional view of a conventional inductance component, and FIG. 17 is a perspective view of a substrate of the inductance component.

In FIG. 16 and FIG. 17, a conventional inductance component comprises a column-shaped substrate 11 made of insulating material, a conductor layer 12 covering the substrate 11, a groove portion 13 formed by cutting the conductor layer 12, a coil portion 14 formed by spirally cutting the groove portion 13, electrodes 16 disposed at both end of the substrate 11, and a covering portion 15 made of insulating resin covering the coil portion 14.

Also, the substrate 11 has steps 17 between the ends thereof, forming a recess 18, as shown in FIG. 17, and the coil portion 14 is formed in the recess 18.

Further, there is provided a non-covering portion not covered with insulating resin at each end of the substrate 11, and the electrode 16 is electrically connected to the conductor layer 12 at the non-covering portion.

In the above conventional configuration, magnetic flux generated in the substrate 11 due to the coil portion 14 leaks from the electrode 16.

Accordingly, inductance cannot be increased, and leaked magnetic flux causes undesirable magnetic effects to the adjacent components.

An object of the present invention is to provide an inductance component having increased inductance and causing minimal undesirable magnetic effects on adjacent components.

DISCLOSURE OF THE INVENTION

The inductance component of the present invention comprises a column-shaped substrate made of magnetic material, a conductor layer covering the end portion and the peripheral surface of the substrate, a coil portion having a groove portion and wire conductor portion formed in the conductor layer covering the peripheral surface, an electrode portion including a conductor layer covering the end portions of the substrate, and a magnetic material portion made of sintered magnetic material formed on the coil portion, wherein the conductor layer has a melting point higher than the sintering temperature of the sintered magnetic material.

Also, the manufacturing process comprises the steps of forming a substrate made of magnetic material, forming a conductor layer on the end portion and peripheral surface of the substrate, forming a coil portion in the conductor layer on the peripheral surface, forming an electrode portion at the end portions of the substrate, and forming a magnetic material portion made of sintered magnetic material on the coil portion by sintering magnetic material at a temperature lower than the melting point of the conductor layer.

By the above configuration and manufacturing method, a magnetic material made of magnetic material is formed on the coil portion, and therefore, magnetic flux generated in the substrate due to the coil portion goes out of the substrate and passes through the magnetic material portion and again passes through the substrate, and thereby, a closed magnetic circuit loop is formed between the magnetic material portion and the substrate. Accordingly, it is possible to obtain an inductance component having increased inductance, less magnetic flux leakage, and reduced undesirable magnetic effects on adjacent components.

DESCRIPTION OF PREFERRED EMBODIMENTS

First Preferred Embodiment

The first preferred embodiment will be described in the following with reference to the drawings.

Figure 1:
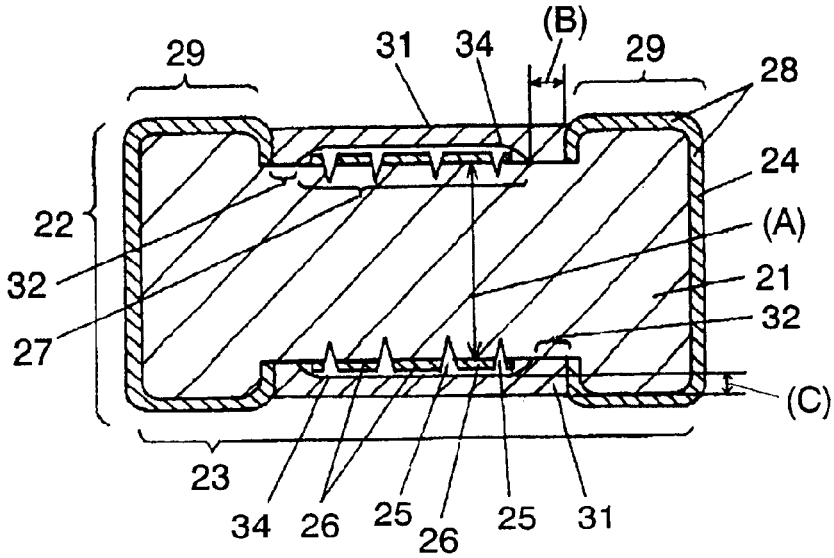
FIG. 1 is a front sectional view of an inductance component in the first preferred embodiment of the present invention.
Figure 2:
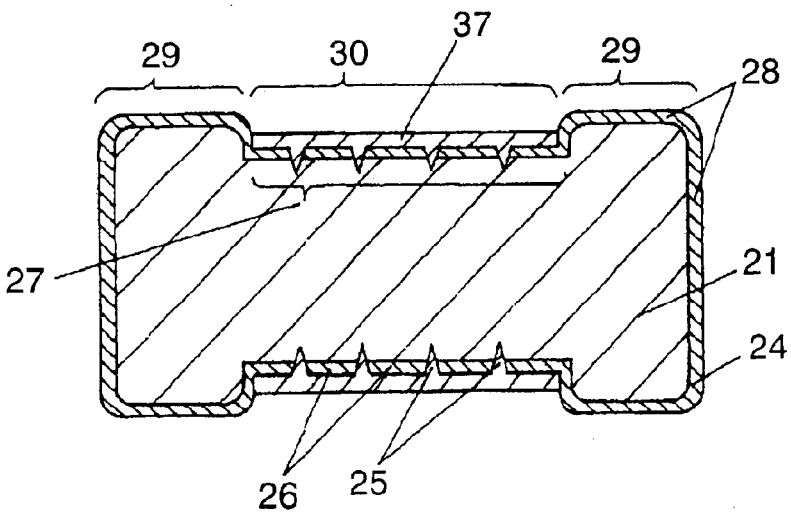
FIG. 2 is a plan sectional view of the inductance component.

In FIG. 1–FIG. 4, an inductance component in the first preferred embodiment of the present invention comprises a column-shaped substrate 21 made of magnetic material, a conductor layer 24 covering the end surfaces 22 and peripheral surface 23 of the substrate 21, a coil portion 27 having a groove portion 25 and wire conductor portion 26, formed by spirally cutting the conductor layer 24 by a laser beam, and an electrode portion 28 formed of the conductor layer 24 covering both end portions 29 of the substrate 21. The substrate 21 is, as shown in FIG. 2, provided with a recess 30 between the end portions 29, and the coil portion 27 is disposed in the recess 30.

Also, there is provided a magnetic material portion 31 made of a magnetic material on the coil portion 27. The magnetic material portion 31 is a sintered magnetic material formed by sintering magnetic material, and the conductor layer 24 is a conductor having a melting point higher than a sintering temperature of the sintered magnetic material.

In this embodiment, the substrate 21 and magnetic material portion 31 are sintered magnetic material made of sintered ferrite formed by sintering Ni—Zn ferrite material, and conductor layer 24 is a 10 to 30 $\mu$m thick conductor formed by an electrolytic plating of Ag or Ag—Pd.

Figure 3:
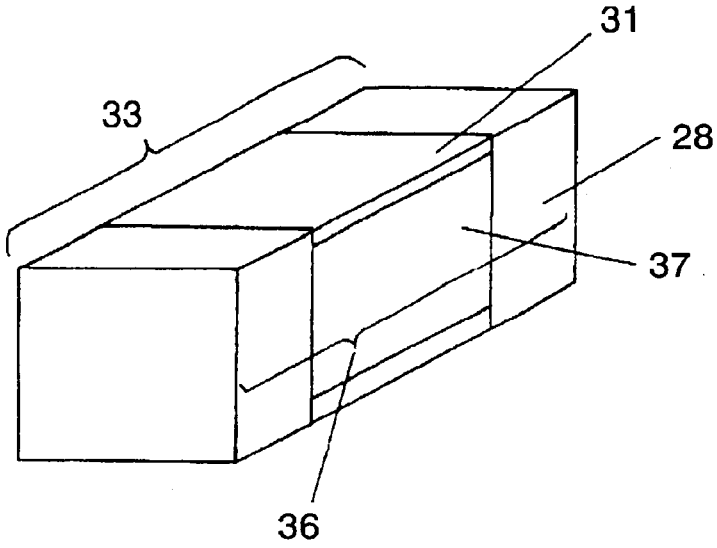
FIG. 3 is a perspective view of the inductance component.
Figure 4:
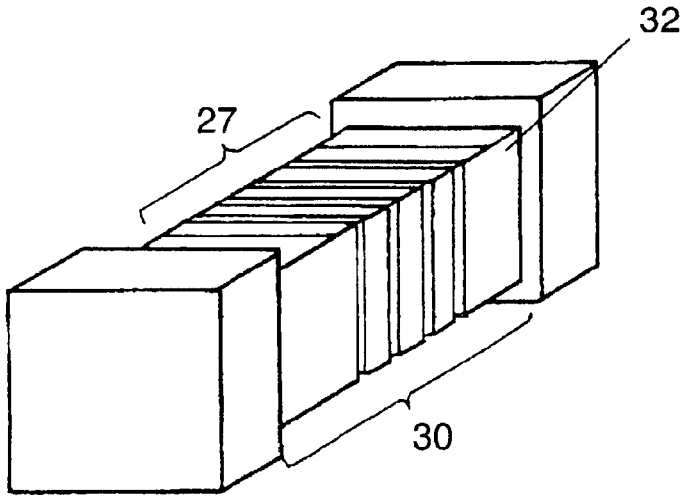
FIG. 4 is a perspective view of a substrate of the inductance component with a conductor layer covered.

Further, the conductor layer 24 is removed between the coil portion 27 and electrode portions 28, thereby forming a conductor layer removed portion 32 where the substrate 21 is exposed, and the magnetic material portion 31 is also provided in the conductor layer removed portion 32 in order to establish contact between the substrate 21 and the magnetic material portion 31. Particularly, the conductor layer removed portion 32 is, as shown in FIG. 3, disposed on one of opposing surfaces 33 of the substrate 21, and the magnetic material portion 31 is also disposed on the coil portion 27 on the surface 33, thereby establishing a contact between the substrate 21 and the magnetic material portion 31 so that they are melted and sintered into one body.

A non-magnetic material 34 made of glass, a non-magnetic material, is disposed in a layer between the coil portion 27 of surface 33 and the magnetic material portion 31, and fills the groove portion 25 of the coil portion 27. A covering portion 37 made of glass is layered on the coil portion 27 of the other surface 36 of the substrate 21.

The cross-section of the surface 33 is shown in FIG. 1, and the cross-section of the surface 36 is shown in FIG. 2.

In the above configuration, in the conductor layer removed portion 32, the total area of facing-to-substrate area (B) of the magnetic material portion 31 facing the substrate 21 is larger than a sectional area in a radial direction of the substrate 21 (hereinafter called as a redial sectional area) (A) at the position where the coil portion 27 is formed, and a total area of the sectional area in the redial direction of the substrate 21 of the magnetic material portion 31 disposed on the coil portion 27 (hereinafter called as a peripheral sectional area) (C) is larger than the redial sectional area (A) of the substrate 21 at the position where the coil portion 27 is formed.

The method of manufacturing an inductance component as described above comprises, as shown in FIG. 6, a conductor layer forming process (A) for forming conductor layer 24 on the substrate by covering the end surface 22 and peripheral surface 23 of the substrate 21, a coil portion forming process (B) for forming coil portion 27 having groove portion 25 and wire conductor portion 26, formed by spirally cutting the conductor layer 24 covering the peripheral surface 23 of the substrate 21, and an electrode portion forming process (C) for forming electrode portion 28 at each end portion 29 of the substrate 21.

Before the conductor layer forming process, there are provided a step of substrate forming process (D) for making a column-shaped substrate 21, and a recess forming process for forming recess 30 where the coil portion 27 is disposed between the end portions 29 of the substrate 21.

Also, after the coil portion forming process, there are provided a conductor layer removed portion forming process (E) for making the substrate 21 exposed by partly removing conductor layer 24 from the surface 33 of the substrate 21, and a non-magnetic material forming process (F) for forming non-magnetic material 34 between the coil portion 27 and magnetic material portion 31. Particularly, in the non-magnetic material forming process (F), non-magnetic material 34 is filled into the groove portion 25 of the coil portion 27 as well.

Further, there is provided a magnetic material forming process (G) for disposing magnetic material portion 31 made of magnetic material in the recess 30 on the coil portion 27 of the surface 33. This magnetic material forming process includes a magnetic material contacting process for establishing contact between the substrate 21 and the magnetic material portion 31, and a sintering process making the magnetic material portion 31 into a sintered magnetic material by sintering magnetic material at a temperature lower than the melting point of the conductor layer 24. Particularly, the magnetic material contacting process is a step of establishing contact between the substrate 21 and the magnetic material portion 31 so that they are melted and sintered into one body in the sintering process.

And, at the final stage of this manufacturing process, there is provided a covering portion forming process (H) for forming covering portion 37 made of glass on the coil portion 27 of the other surface 36 of the substrate 21.

The operation of an inductance component having the above configuration will be described in the following.

Figure 5A:
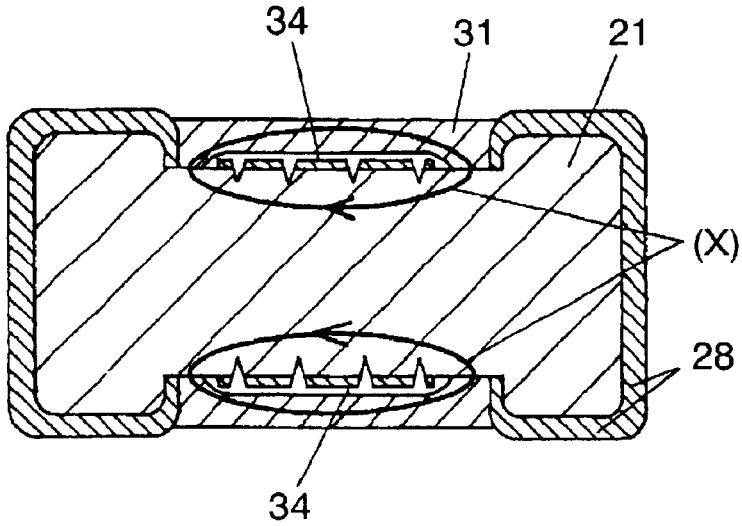
FIGS. 5A and 5B are sectional views showing the flow of magnetic flux generated by the coil portion of the inductance component.
Figure 5B:
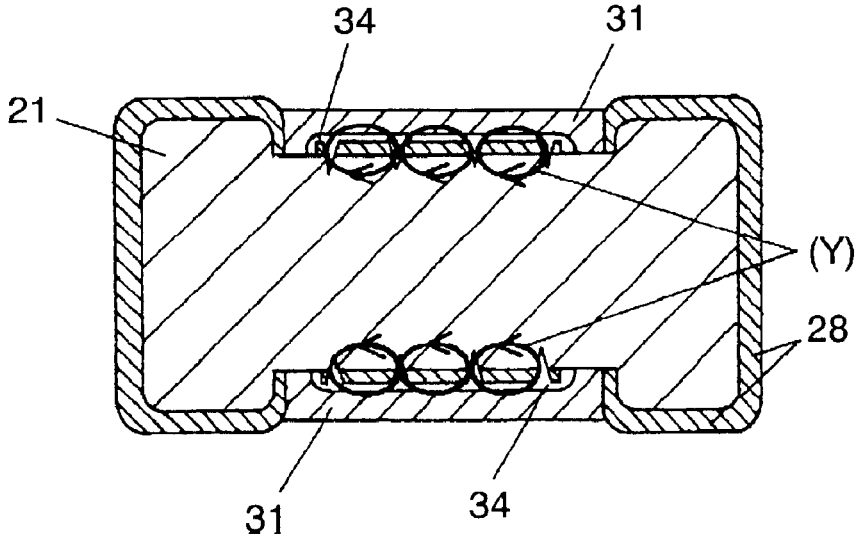

An inductance manufactured by the manufacturing method as described above is provided with magnetic material portion 31 made of magnetic material on coil portion 27. Therefore, as shown in FIG. 5A, magnetic flux (X) generated in substrate 21 due to coil portion 27 goes out of the substrate 21 and passes through the magnetic material portion 31 and again passes through the substrate 21. Consequently, there is practically no magnetic flux (Y) (FIG. 5B) that passes around the wire conductor portion 26 of the coil portion 27, forming a closed magnetic circuit loop between magnetic material portion 31 and substrate 21, and thereby, the inductance may be increased. Further, since leakage of magnetic flux (X) from the inductance component is relatively low, it is possible to suppress undesirable magnetic effects on adjacent components.

Particularly, according to the present preferred embodiment, since magnetic material portion 31 is a sintered magnetic material formed by sintering magnetic material, the magnetic material portion 31 is increased in magnetic permeability, and the inductance of the inductance component may be increased, and also, undesirable magnetic effects on adjacent components can be further suppressed.

Also, since the conductor layer 24 is a conductor having a melting point higher than the sintering temperature of the sintered magnetic material, even when magnetic material is disposed and sintered on the coil portion 27, it causes no melting of the conductor layer 24 at the sintering temperature and it is In the present preferred embodiment, making a paste by mixing the magnetic material with an organic solvent, binder or the like and applying the obtained paste on the coil portion 27, make it possible to dispose a magnetic material even in the case of an inductance component having a complicated shape, and to form more precisely a closed magnetic circuit loop between magnetic material portion 31 and substrate 21, and to increase the inductance.

Also, since there is provided a recess 30 between the end portions 29 of the substrate 21, the magnetic material portion 31 is surrounded by the end portions 29, making the magnetic flux (X) easier to pass from the substrate 21 to the magnetic material portion 31, then increasing in magnetic permeability, and the inductance may be further increased. Particularly, the magnetic material portion 31 is disposed in the recess 30, and therefore, the magnetic material portion 31 does not protrude from the end portions 29 of the substrate 21, which provides improved flatness of the inductance component.

In addition, in the present preferred embodiment, a conductor layer removed portion 32 is provided between coil portion 27 and electrode portion 28, and magnetic material portion 31 is disposed in the conductor layer removed portion 32, thereby establishing contact between substrate 21 and magnetic material portion 31. Accordingly, when magnetic flux (X) generated at the coil portion 27 passes from the substrate 21 to the magnetic material portion 31, the magnetic flux (X) passes via the conductor removed portion 32, with minimal blockage of the flow of the magnetic flux (X) by the conductor layer 24. As a result, it is possible to realize efficient flow of the magnetic flux (X), increase the magnetic permeability, and to further increase the inductance of the inductance component.

Particularly, since the substrate 21 and magnetic material portion 31 are melted and sintered into one body, there exists practically no interface between the substrate 21 and magnetic material portion 31, and it is possible to make a smooth flow of magnetic flux (X) and to further increase the inductance.

Also, since the substrate 21 is column-shaped and the conductor layer removed portion 32 is disposed on two surfaces 33 opposing to each other, and also, the magnetic material portion 31 is disposed on the coil portion 27 of surface 33, most of the magnetic flux (X) may pass from the substrate 21 to the magnetic material portion 31 via the conductor layer removed portion 32 provided on the surface 33. Also, it is possible to realize efficient flow of the magnetic flux (X) because the magnetic flux (X) flows symmetrically, resulting in enhancing the magnetic permeability, and the inductance may be increased.

Particularly, only protective glass as a covering portion 37 is formed on the other two surfaces 36 opposing to each other and therefore, the magnetic flux (X) does not flow through the glass on the coil portion 27. Further, when an inductance component is mounted on a circuit board, effects from the circuit patterns or soldered connections of the circuit board can be minimized by mounting the inductance component in such manner that the surfaces 33 with magnetic material portion 31 disposed thereon are positioned perpendicular to the circuit board.

In addition, there is provided non-magnetic material 34 between coil portion 27 and magnetic material portion 31, and the groove portion 25 of the coil portion 27 is also filled with the non-magnetic material 34. Therefore, the groove portion 25 of coil portion 27 and the adjacent area of wire conductor portion 26 are coated with non-magnetic material 34, and a closed magnetic circuit loop due to a flow of magnetic flux (X) is not formed between neighboring wire conductor portions 26 of the coil portion 27. As a result, most of the magnetic flux (X) generated due to the coil portion 27 passes from the substrate 21 to the magnetic material portion 31 and from the magnetic material portion 31 to the substrate 21, thus forming a closed magnetic circuit loop and enhancing the magnetic permeability, and the inductance may be further increased.

Particularly, it is possible to further enhance the above effect since non-magnetic material 34 is layered between coil portion 27 and magnetic material portion 31, and at the same time, the non-magnetic material 34 is made of glass. When the non-magnetic material 34 is not provided, a corrosion of the coil portion 27 may occur because the magnetic material portion 31 is a sintered magnetic material formed by sintering magnetic material including a number of small pores or the like, and through the pores moisture in the air is absorbed into the magnetic material portion 31 to corrode the coil portion 27. However, in the present preferred embodiment, a layer of glass is disposed between the coil portion 27 and magnetic material portion 31, and therefore, it is possible to suppress absorption of water in the air and to prevent water from contacting the coil portion 27.

Further, the total area of facing-to-substrate area (B) of the magnetic material portion 31 facing to the substrate in the conductor layer removed portion 32 is larger than the radial sectional area (A) of the substrate 21 at the position where the coil portion 27 is formed, and the total area of the peripheral sectional area (C) of the coil portion of the magnetic material portion 31 disposed on the coil portion 27 is larger than the radial sectional area (A) of the substrate 21 at the position where the coil portion 27 is formed. As a result, magnetic flux (X) generated at the coil portion 27 is not saturated and efficiently passes from the substrate 21 to the magnetic material portion 31, thereby enhancing the magnetic permeability, and thus the inductance may be increased.

Moreover, the substrate 21 and magnetic material portion 31 are sintered magnetic material made of sintered ferrite formed by sintering Ni—Zn ferrite material, and the conductor layer 24 is a conductor made of Ag or Ag—Pd. Accordingly, when magnetic material is sintered at the sintering temperature, undesirable effects caused by a heat for the sintering have minimal impact on the conductor layer 24, thereby improving the conduction reliability of the conductor layer 24.

In this way, according to the first preferred embodiment of the present invention, as shown in FIG. 5A, magnetic flux (X) generated in the substrate 21 due to coil portion 27 goes out from the substrate 21 and passes through the magnetic material portion 31 and again passes through the substrate 21, thereby forming a closed magnetic circuit loop between the magnetic material portion 31 and the substrate 21, and thus the inductance can be increased, and also leakage of the magnetic flux (X) is low, and it is possible to suppress undesirable magnetic effects on adjacent components.

Also, short circuits or connection trouble due to melting of the conductor layer 24 and corrosion of coil portion 27 caused by water absorbed in the sintered magnetic material can be prevented, and also it is possible to suppress the deterioration of the conduction reliability of the conductor layer 24.

Further, the magnetic flux (X) does not pass through the other opposing surfaces 36, and when the inductance component is mounted on a circuit board, effects from the circuit patterns or soldered connections of the circuit board can be minimized by mounting the inductance component in such manner that opposing surfaces 33 (where magnetic material portion 31 is disposed) are positioned perpendicular to the mounted board.

In the first preferred embodiment of the present invention, the non-magnetic material 34 layered between the coil portion 27 and magnetic material portion 31 is made of glass, but it is also possible to obtain similar effects by using air or ceramic as the non-magnetic material 34.

Also, covering portion 37 made of glass is disposed on the coil portion 27 of the other opposing surface 36 of the substrate 21, and it is also possible to obtain similar effects by using insulating resin as covering portion 37.

Figure 7:
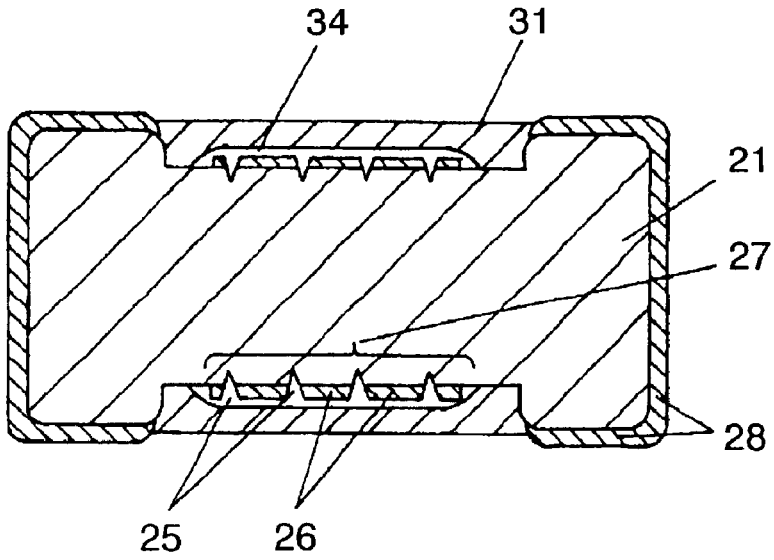
FIG. 7 is a front sectional view of another inductance component.
Figure 8:
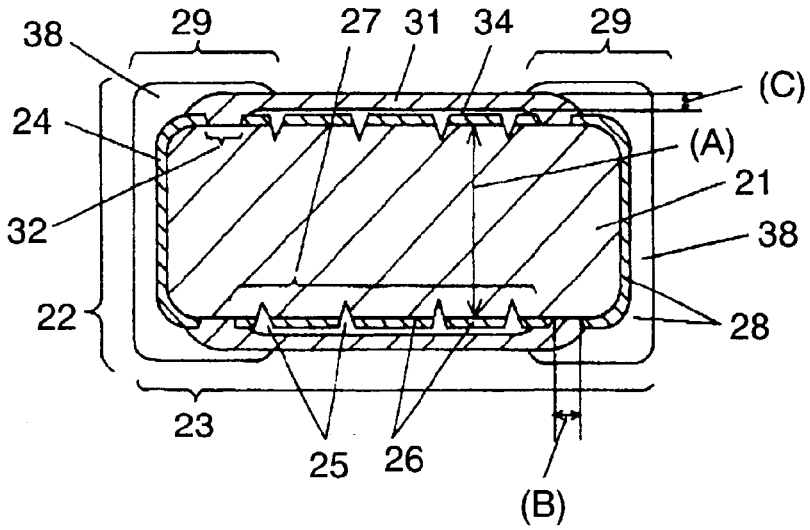
FIG. 8 is a front sectional view of an inductance component in the second preferred embodiment of the present invention.
Figure 9:
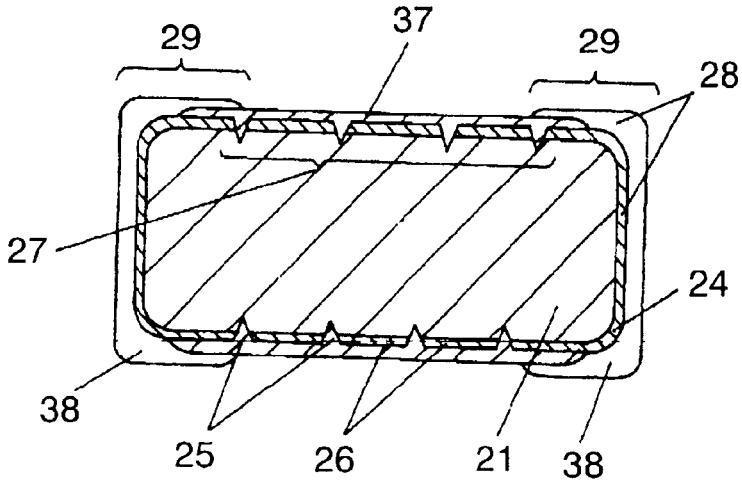
FIG. 9 is a plan sectional view of the inductance component
Figure 10:
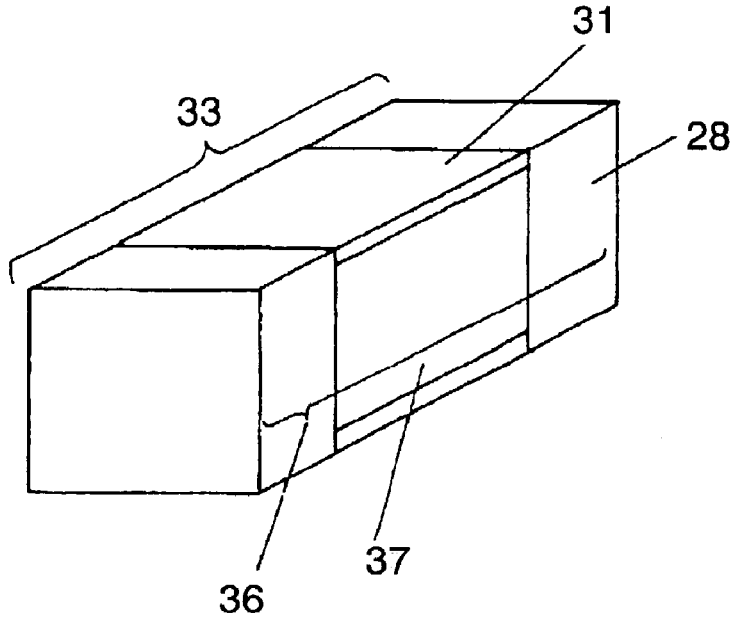
FIG. 10 is a perspective view of the inductance component.
Figure 11:
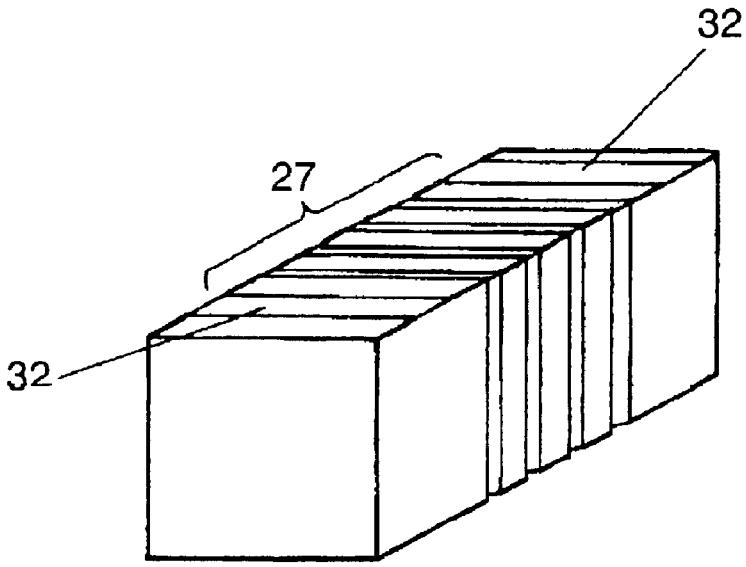
FIG. 11 is a perspective view of a substrate of the inductance component with a conductor layer covered.

Further, the contact between each end portion 29 of the substrate 21 and the magnetic material portion 31 is established via conductor layer 24, and it is also possible to establish direct contact between each end portion 29 of the substrate 21 and the magnetic material portion 31, as shown in FIG. 7.

Second Preferred Embodiment

The second preferred embodiment will be described in the following with reference to the drawings.

The inductance component in the second preferred embodiment of the present invention is an improved version of the inductance component in the first preferred embodiment of the present invention.

In FIG. 8 to FIG. 11, the inductance component in the second referred embodiment of the present invention comprises a parallelepiped column shaped substrate 21 made of magnetic material, a conductor layer 24 covering the end surface 22 and peripheral surface 23 of the substrate 21, a coil portion 27 having groove portion 25 and wire conductor portion 26, formed by spirally cutting the conductor layer 24 covering the peripheral surface 23 of the substrate 21, and an electrode portion 28 of the conductor layer 24 covering each end portion 29 of the substrate 21.

Also, on the coil portion 27 is disposed a magnetic material portion 31 made of magnetic material, and the magnetic material portion 31 is a sintered magnetic material formed by sintering magnetic material, and the conductor layer 24 is a conductor having a melting point higher than the sintering temperature of the sintered magnetic material.

Further, an electrode layer 38 formed of a conducting material covers each end portion of the coil portion 27 and each end portion of magnetic material portion 31 disposed on the coil portion 27, and the electrode layer 38 is a part of electrode portion 28.

That is, the inductance component of the present preferred embodiment includes no recess in the middle of substrate 21, in contrast with the configuration of the first preferred embodiment, and the electrode layer 38 adjacent each end portion of coil portion 27 is added in the configuration and covers each end portion of magnetic material portion 31.

The substrate 21 and magnetic material portion 31, the material, configuration and forming method of the conductor layer 24 are identical with those in the first preferred embodiment.

The present preferred embodiment is same as the first preferred embodiment with respect to the contacting and sintering method for the magnetic material portion 31 and conductor layer removed portion 32, exposing the substrate 21 by removing the conductor layer 24 between the coil portion 27 and electrode portion 28. The present preferred embodiment is also same as the first preferred embodiment with respect to the material, configuration and forming method for non-magnetic material 34 and covering portion 37 which are both made of glass.

The electrode layer 38 is disposed at each end portion 37 and adjacent to each end portion of the coil portion 27.

Also, in the conductor layer removed portion 32 disposed between the coil portion 27 and the electrode portion 29 at one end portion, the total area of facing-to-substrate area (B) of the magnetic material portion 31 facing the substrate 21 is larger than the radial sectional area (A) of the substrate 21 at the position where the coil portion 27 is formed, and the total area of the peripheral sectional area (C) of the coil portion of the magnetic material portion 31 disposed on the coil portion 27 is larger than the radial area (A) of the substrate 21 at the position where the coil portion 27 is formed.

Figure 6:
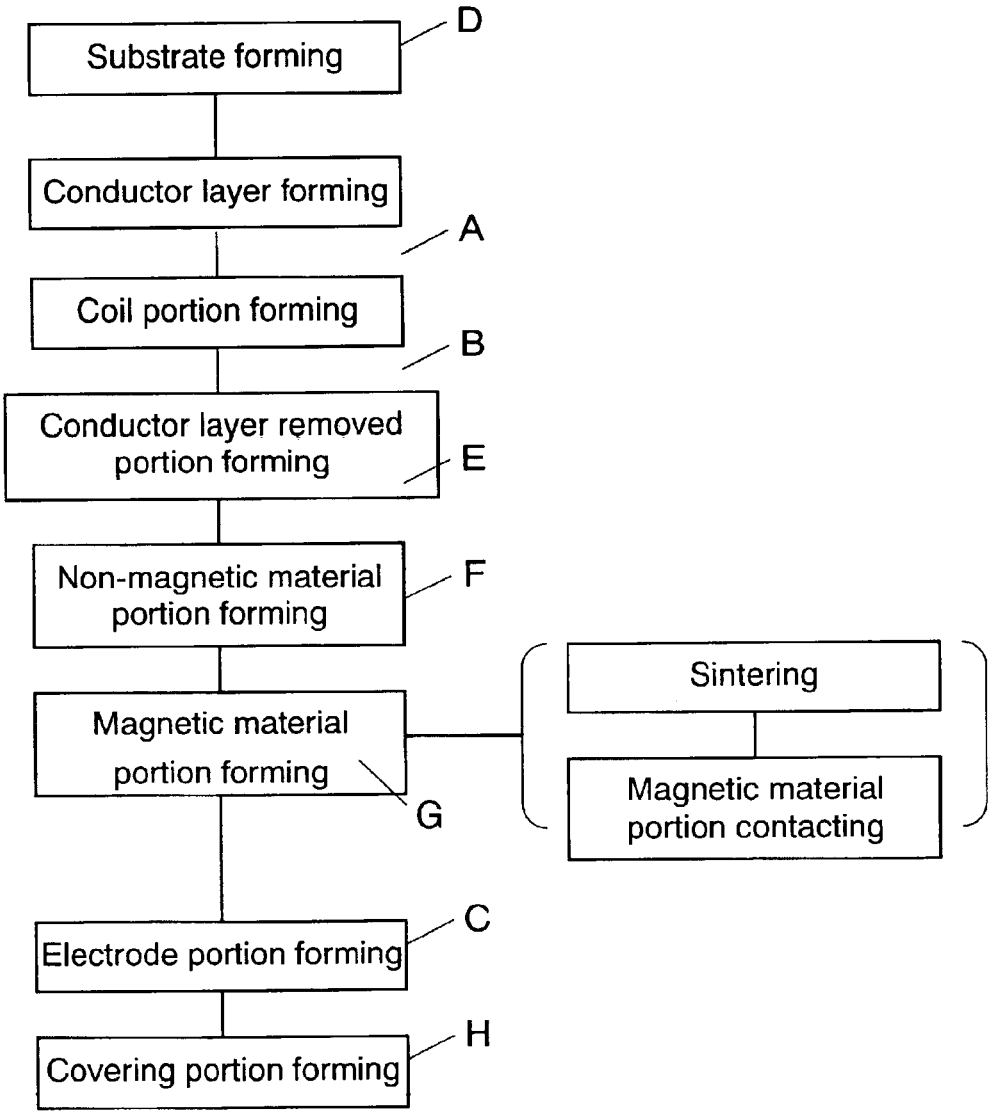
FIG. 6 is a manufacturing process chart of the inductance component.

Regarding the method of manufacturing the above inductance component, the differences with the manufacturing process in the first preferred embodiment shown in FIG. 6 will be described in the following.

Figure 13:
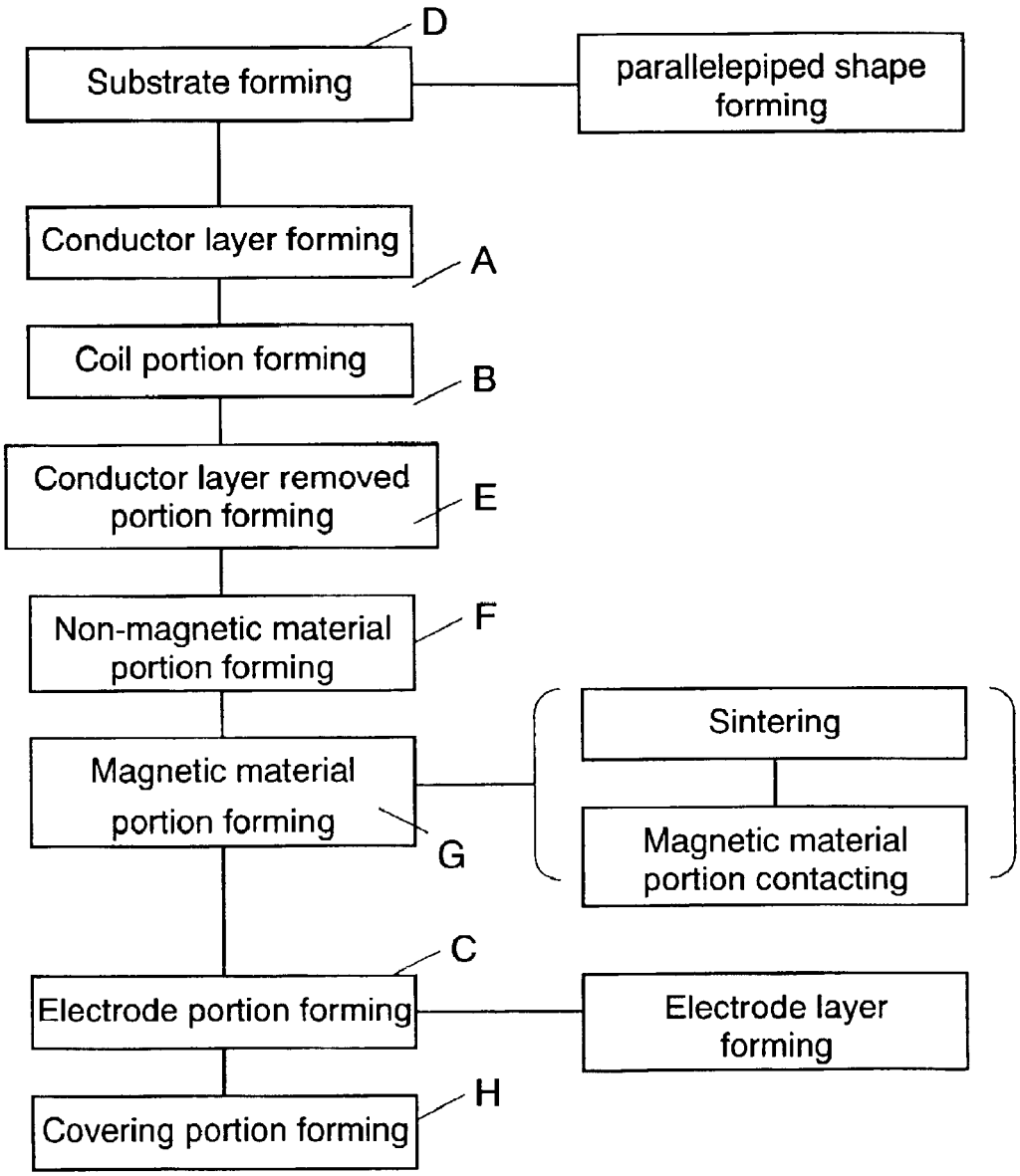
FIG. 13 is a manufacturing process chart of the inductance component.

In the present preferred embodiment, as shown in FIG. 13, recess 30 is not famed in the substrate 21 during the substrata forming process (D), but there is provided a parallelepiped shape forming process for forming the substrate 21 into parallelepiped shape. In the coil portion forming process (B) coil portion 27 is formed from one peripheral end of the substrate 21 to another peripheral end thereof. The electrode portion forming process (C) includes an electrode layer forming process for forming electrode layer 38 made of conducting material on the magnetic material portion 31 disposed on the coil portion 27 so as to oppose to the coil portion 27, and the electrode layer 38 is a part of the electrode portion 28.

The operation of an inductance component having the above configuration is described in the following.

Figure 12A:
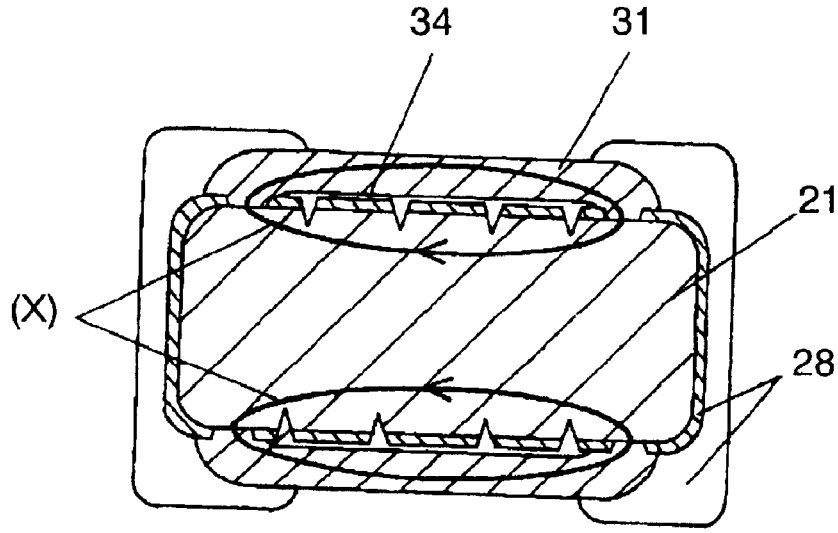
FIGS. 12A and 12B are sectional views showing the flow of magnetic flux generated by the coil portion of the inductance component.
Figure 12B:
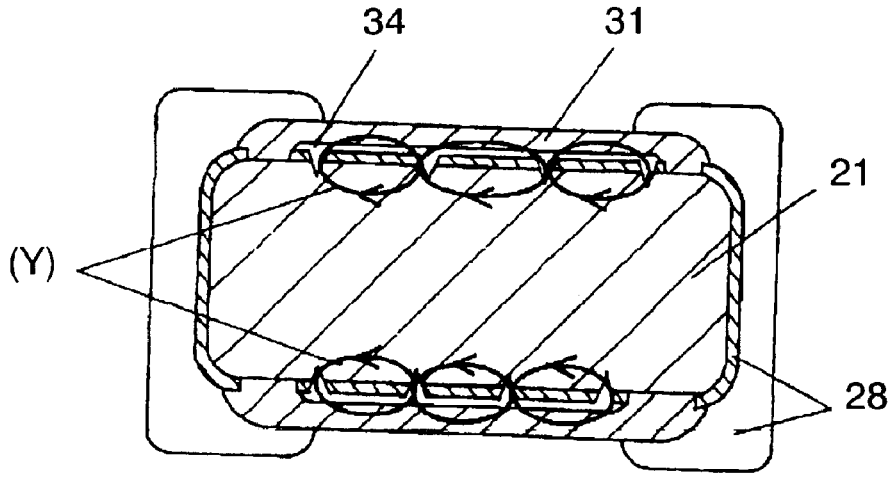

An inductance component manufactured by the above manufacturing method is provided with magnetic material portion 31 made of magnetic material on the coil portion 27, and as shown in FIG. 12A, magnetic flux (X) generated in the substrate 21 by the coil portion 27 goes out of the substrate 21 and passes through the magnetic material portion 31 and again passes through the substrate 21. As a result, there is practically no magnetic flux (Y) that passes around the wire conductor portion 26 of the coil portion 27 as shown in FIG. 12B, thereby forming a closed magnetic circuit loop between the magnetic material portion 31 and the substrate 21. Accordingly, the inductance of the inductance component may be increased and the magnetic flux (X) is minimally leaked, if at all, making it possible to suppress undesirable magnetic effects on adjacent components.

Particularly, since the magnetic material portion 31 is a sintered magnetic material formed by sintering magnetic material, the magnetic permeability is enhanced and the inductance may be further increased, and further suppression of undesirable magnetic effects on adjacent components is possible.

Also, the conductor layer 24 is a conductor having a melting point higher than the sintering temperature of the sintered magnetic material, and therefore, even when magnetic material is disposed and sintered on the coil portion 27, such sintering will not cause melting of the conductor layer 24 at the sintering temperature and is possible to prevent generation of short circuits or connection trouble due to melting of the conductor layer 24, and there will be no deterioration of the conduction reliability of the conductor layer 24.

In the present preferred embodiment, making a paste by mixing the magnetic material with a binder or the like and applying it on the coil portion 27, make it possible to dispose magnetic material even in the case of an inductance component having a complicated shape and to precisely form a closed magnetic circuit loop between the magnetic material portion 31 and the substrate 21, and thus the inductance may be increased.

An inductance component manufactured by the above manufacturing method is provided with magnetic material portion 31 made of magnetic material on the coil portion 27, and as shown in FIG. 12A, magnetic flux (X) generated in the substrate 21 by the coil portion 27 goes out of the substrate 21 and passes through the magnetic material portion 31 and again passes through the substrate 21. As a result, there is practically no magnetic flux (Y) that passes around the wire conductor portion 26 of the coil portion 27 as shown in FIG. 12B, thereby forming a closed magnetic circuit loop between the magnetic material portion 31 and the substrate 21. Accordingly, the inductance of the inductance component may be increased and the magnetic flux (X) is minimally leaked, if at all, making it possible to suppress undesirable magnetic effects on adjacent components.

Particularly, since the magnetic material portion 31 is a sintered magnetic material formed by sintering magnetic material, the magnetic permeability is enhanced and the inductance may be further increased, and further suppression of undesirable magnetic effects on adjacent components is possible.

Also, the conductor layer 24 is a conductor having a melting point higher than the sintering temperature of the sintered magnetic material, and therefore, even when magnetic material is disposed and sintered on the coil portion 27, such sintering will not cause melting of the conductor layer 24 at the sintering temperature and is possible to prevent generation of short circuits or connection trouble due to melting of the conductor layer 24, and there will be no deterioration of the conduction reliability of the conductor layer 24.

Particularly, since the substrate 21 and the magnetic material portion 31 are melted and sintered into one body, there is practically no interface between the substrate 21 and the magnetic material portion 31, making easier the flow of magnetic flux (X), and the inductance may be further increased.

Also, the conductor layer removed portion 32 is disposed on two surfaces 33 of the substrate 21 opposite each other, and also the magnetic material portion 31 is disposed on the coil portion 27 of the pair of surfaces 33 where the conductor layer removed portion 32 is formed. Accordingly, most of the magnetic flux (X) passes from the substrate 21 to the magnetic material portion 31 via the conductor layer removed portion 32, and at the same time, the magnetic flux (X) can be passed symmetrically. In this way, the magnetic flux (X) is efficiently passed, enhancing the magnetic permeability, and the inductance may be increased.

Particularly, only protective glass as a covering portion 37 is formed on the other two surfaces 36 opposing to each other, and therefore, the magnetic flux (X) does not pass through the glass on the coil portion 27. Also, when an inductance component is mounted on a circuit board, effects from the circuit patterns or soldered connections of the mounted board can be minimized by mounting the inductance component in such manner that the pair of surfaces 33 with magnetic material portion 31 disposed thereon are positioned perpendicular to the mounted board.

In addition, there is provided non-magnetic material 34 between coil portion 27 and magnetic material portion 31, and the groove portion 25 of the coil portion 27 is also filled with the non-magnetic material 34. Therefore, the groove portion 25 of coil portion 27 and the adjacent area of wire conductor portion 26 are coated with non-magnetic material 34, and a closed magnetic circuit loop caused due to passage of magnetic flux (X) is not formed between the coil portion 27 and wire conductor portion 26. As a result, most of the magnetic flux (X) generated by the coil portion 27 passes from the substrate 21 to the magnetic material portion 31 and from the magnetic material portion 31 to the substrate 21, forming a closed magnetic circuit loop, resulting in enhancing the magnetic permeability, and thus the inductance may be further increased.

Particularly, it is possible to further enhance the above effect because non-magnetic material 34 is layered between the coil portion 27 and magnetic material portion 31, and also, the non-magnetic material 34 is made of glass.

When the non-magnetic material 34 is not provided, there is a problem of corrosion of the coil portion 27 because the magnetic material portion 31 is a sintered magnetic material formed by sintering magnetic material having a number of small pores or the like through which moisture contained in the air is absorbed into the magnetic material portion 31. However, in the present preferred embodiment, since a layer of glass is formed between the coil portion 27 and magnetic material portion 31, and therefore, it is possible to suppress absorption of moisture in the air and to prevent water from contacting the coil portion 27.

Also, the total area of facing-to-substrate area (B) of the magnetic material portion 31 facing the substrate 21 in the conductor layer removed portion 32 is larger than the radial sectional area (A) of the substrate 21 at the position where the coil portion 27 is formed, and the total area of the peripheral sectional area (C) of the coil portion of the magnetic material portion 31 disposed on the coil portion 27 is larger than the radial sectional area (A) of the substrate 21 at the position where the coil portion 27 is formed. Accordingly, magnetic flux (X) generated at the coil portion 27 is not saturated and efficiently passes from the substrate 21 to the magnetic material portion 31. As a result, the magnetic permeability is enhanced, and the inductance may be increased.

In addition, the substrate 21 and magnetic material portion 31 are sintered magnetic material made of sintered ferrite formed by sintering Ni—Zn ferrite material, and the conductor layer 24 is a conductor made of Ag or Ag—Pd. Accordingly, when magnetic material is sintered at the sintering temperature, undesirable effects caused by a heat for the sintering have minimal impact on the conductor layer 24, thereby improving the conduction reliability of the conductor layer 24.

Thus, according to the present preferred embodiment, as shown in FIG. 12A, magnetic flux (X) generated in the substrate 21 by coil portion 27 goes out of the substrate 21 and passes through the magnetic material portion 31 and again passes through the substrate 21. Then, a closed magnetic circuit loop is formed between the magnetic material portion 31 and the substrate 21, and thus the inductance may be increased, and also leakage of the magnetic flux (X) is relatively low, and it is possible to suppress undesirable magnetic effects on adjacent components.

Also, short circuits or connection trouble due to melting of the conductor layer 24 and corrosion of coil portion 27 caused by water absorbed in the sintered magnetic material can be prevented, and also it is possible to suppress the deterioration of the conduction reliability of the conductor layer 24.

Further, the magnetic flux (X) does not pass through the other opposing surfaces 36, and when mounted on the circuit board, effects from the circuit patterns or soldered connections of the mounted board can be minimized by mounting the inductance component in such manner that the two opposing surfaces 33 (where magnetic material portion 31 is disposed) are perpendicular to the circuit board.

In one preferred embodiment of the present invention, the non-magnetic material 34 layered between the coil portion 27 and magnetic material portion 31 is a glass layer, but it is also possible to obtain similar effects by using a ceramic layer. Further, it is possible to provide an air layer as the non-magnetic material 34. Such air layer can be formed, for example, by disposing a thermosetting resin layer at a place of the non-magnetic material 34, and burn out the thermosetting resin layer during firing of the magnetic material portion 31.

Also, covering portion 37 disposed on the coil portion 27 of the other opposing surfaces 36 of the substrate 21 is made of glass, and it is also possible to obtain similar effects by using insulating resin.

Figure 14:
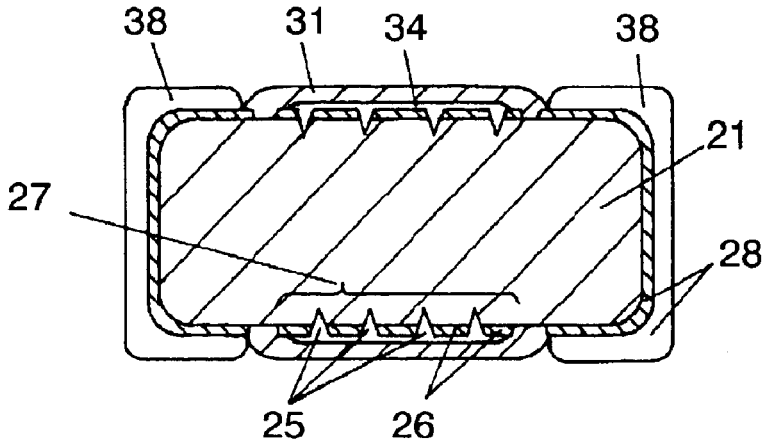
FIG. 14 is a front sectional view of another inductance component.
Figure 15:
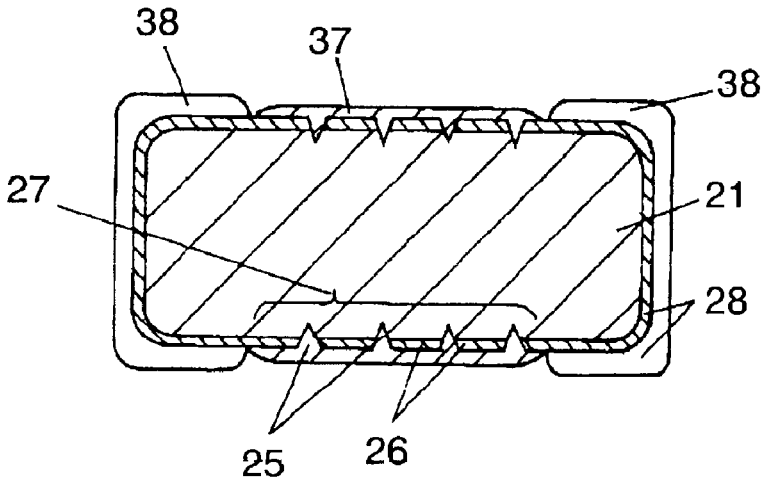
FIG. 15 is a plan sectional view of another inductance component.
Figure 16:
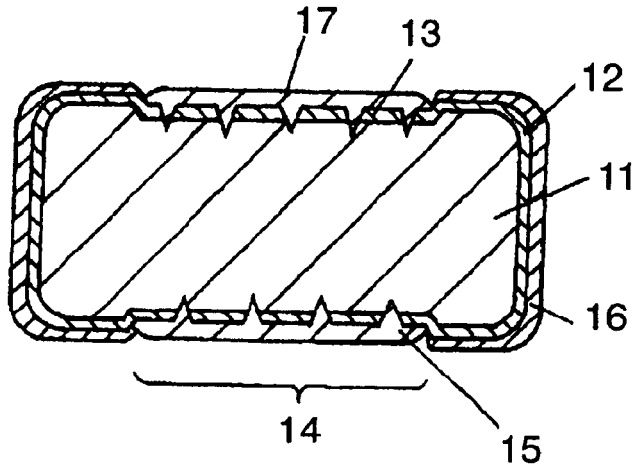
FIG.16 PRIOR ART
FIG. 16 is a sectional view of a conventional inductance component.
Figure 17:
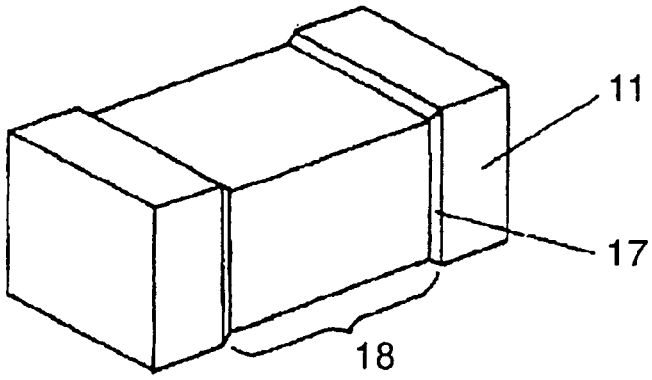
FIG.17 PRIOR ART
FIG. 17 is a perspective view of the substrate of the inductance component.

Further, the electrode portion 28 disposed at each end portion 29 of the substrate 21 is provided with electrode layer 38 formed on magnetic material portion 31 so as to oppose to the end of the coil portion 27. However, as shown in FIG. 14 and FIG. 15, it is also possible to form the electrode layer 38, not on the magnetic material portion 31 and covering portion 37 and so as not to oppose to the coil portion 27.

In the above preferred embodiment, as a cutting method, a laser method is described, but the cutting method is not limited to the laser method. It is a matter of course that mechanical cutting, chemical etching, and other well-known cutting methods may be employed.

INDUSTRIAL APPLICABILITY

As described above, according to the present invention, magnetic flux generated in the substrate by the coil portion goes out of the substrate and passes through the magnetic material portion and again passes through the substrate, thereby forming a closed magnetic circuit loop between the magnetic material portion and the substrate. Accordingly, it is possible to provide an inductance component increased in inductance, less in magnetic flux leakage, and reduced in undesirable magnetic effects to adjacent components.

What is claimed is:

1. An inductance component comprising:

a column-shaped substrate comprising two end portions and a peripheral surface, and made of magnetic material;

a conductor layer covering the two end portions and the peripheral surface of said substrate;

said conductor layer comprising an electrode portion covering each of said two end portions, and a coil portion having a groove portion and a wire conductor portion; and a magnetic material portion made of a sintered magnetic material on said coil portion, wherein said conductor layer has a melting point higher than a sintering temperature of said sintered magnetic material.

2. The inductance component of claim 1, wherein said coil portion is located in a recess between the end portions of said substrate.

3. The inductance component of claim 1, wherein said coil portion is located in a recess between the end portions of said substrate, and said magnetic material portion is located in said recess.

4. The inductance component of claim 1, wherein in said conductor layer there is a gap located between said coil portion and each of said electrode portions.

5. The inductance component of claim 1, wherein said substrate and said magnetic material comprise sintered ferrite.

6. The inductance component of claim 1, wherein said substrate and said magnetic material are sintered Ni—Zn ferrite, and said conductor layer is one of Ag and Ag—Pd alloy.

7. The inductance component of claim 1, wherein in said conductor there is a gap located between said coil portion and each of said electrode portions, and the magnetic material portion is located in said gap and is in contact with said substrate.

8. The inductance component of claim 7, wherein an area of said magnetic material facing said column-shaped substrate is larger than a cross-sectional area of said column-shaped substrate in a radial direction of said column-shaped substrate at a position where said coil portion is located.

9. The inductance component of claim 7, wherein a cross-sectional area of said magnetic material portion on said coil portion in the radial direction of said column-shaped substrate is larger than a cross-sectional area of the column-shaped substrate in the radial direction of said column-shaped substrate at the position where said coil portion is located.

10. The inductance component of claim 7, wherein said substrate and said magnetic material portion comprise an integrally sintered body.

11. The inductance component of claim 7, wherein said substrate has a parallelepiped shape, and said gap is located on each of a pair of opposing surfaces of said substrate, and said magnetic material portion is located on a coil portion located on each of said pair of opposing surfaces of said substrate.

12. The inductance component of claim 11, further comprising a covering portion made of insulating resin, said covering portion located on a coil portion on one of opposing surfaces of said substrate.

13. The inductance component of claim 11, further comprising a covering portion made of glass, said covering portion located on a coil portion on one of opposing surfaces of said substrate.

14. The inductance component of claim 11, wherein an electrode layer is located on each end portion of said coil portion and on each end portion of said magnetic material portion located on said coil portion, said electrode layer being a part of said electrode portion.

15. The inductance component of claim 11, wherein said coil portion is located from one peripheral end of said substrate to another peripheral end thereof.

16. The inductance component of claim 1, further comprising a non-magnetic material portion located between said coil portion and said magnetic material.

17. The inductance component of claim 16, wherein the groove portion of said coil portion is also filled with said non-magnetic material portion.

18. The inductance component of claim 16, wherein said non-magnetic material portion is a material selected from the group consisting of a glass layer, ceramic layer and air layer located between said coil portion and said magnetic material portion.

* * * * *

UNITED STATES PATENT AND TRADEMARK OFFICE

CERTIFICATE OF CORRECTION

PATENT NO. : 6,864,774 B2
DATED : March 8, 2005
INVENTOR(S) : Toyonori Kanetaka et al.

It is certified that error appears in the above-identified patent and that said Letters Patent is hereby corrected as shown below:

Title page,
Item [22], PCT Filed, correct the date from "October 10, 2001" to -- October 16, 2001 --.

Signed and Sealed this

Twenty-eighth Day of June, 2005

JON W. DUDAS
*Director of the United States Patent and Trademark Office*